US005803722A

United States Patent [19]

Noboru et al.

[11] Patent Number: 5,803,722

[45] Date of Patent: Sep. 8, 1998

[54] ROTATING SCROLL COMPRESSOR HAVING A MOVABLE BEARING MEMBER

[75] Inventors: Yoshinori Noboru; Kazuyoshi Sugimoto, both of Gunma-ken, Japan

[73] Assignee: Sanyo Electric Co., Ltd., Osaka, Japan

[21] Appl. No.: 654,018

[22] Filed: May 28, 1996

Related U.S. Application Data

[63] Continuation of Ser. No. 409,710, Mar. 24, 1995, abandoned.

[30] Foreign Application Priority Data

Mar. 24, 1994 [JP] Japan ..... 6-076300

[51] Int. Cl.[6] ..... F04C 18/04

[52] U.S. Cl. ..... 418/55.5; 418/57; 418/188

[58] Field of Search ..... 418/55.5, 57, 188

[56] References Cited

U.S. PATENT DOCUMENTS

| | | | |
|---|---|---|---|
| 4,575,318 | 3/1986 | Blain | 418/57 |
| 5,090,876 | 2/1992 | Hashizume et al. | 418/55.3 |
| 5,212,964 | 5/1993 | Utter et al. | 62/498 |
| 5,242,284 | 9/1993 | Mitsunaga et al. | 418/55.5 |
| 5,449,279 | 9/1995 | Hill et al. | 418/55.5 |

FOREIGN PATENT DOCUMENTS

| | | | |
|---|---|---|---|
| 0 478 795 A1 | 4/1992 | European Pat. Off. . | |
| 4171290 | 6/1992 | Japan | 418/57 |
| 4269389 | 9/1992 | Japan | 418/55.5 |
| 4292591 | 10/1992 | Japan | 418/55.5 |
| WO 90/02248 | 3/1990 | WIPO . | |
| WO 93/17241 | 9/1993 | WIPO . | |

*Primary Examiner*—John J. Vrablik
*Attorney, Agent, or Firm*—Darby & Darby

[57] ABSTRACT

A rotating type scroll compressor according to the present invention having a closed shell that houses an electric drive member and a scroll compressing member, the scroll compressing member having a drive scroll member having a drive scroll member and a follower scroll member, the drive scroll member having a spiral shape wrap formed on a end plate and being driven by the electric drive member, the follower scroll member having a center axial line that deviates from a center axial line of the drive scroll member and a spiral shape wrap fitting to the wrap of the drive scroll member, said rotating type scroll compressor comprising rotating shaft portions to which radial force of the rotating drive scroll member and the follower scroll member is applied, said rotating shaft portions being disposed at an upper portion and a lower portion of the wraps to which the radial load of fluid is applied.

3 Claims, 9 Drawing Sheets

FIG. 8A
(PRIOR ART)
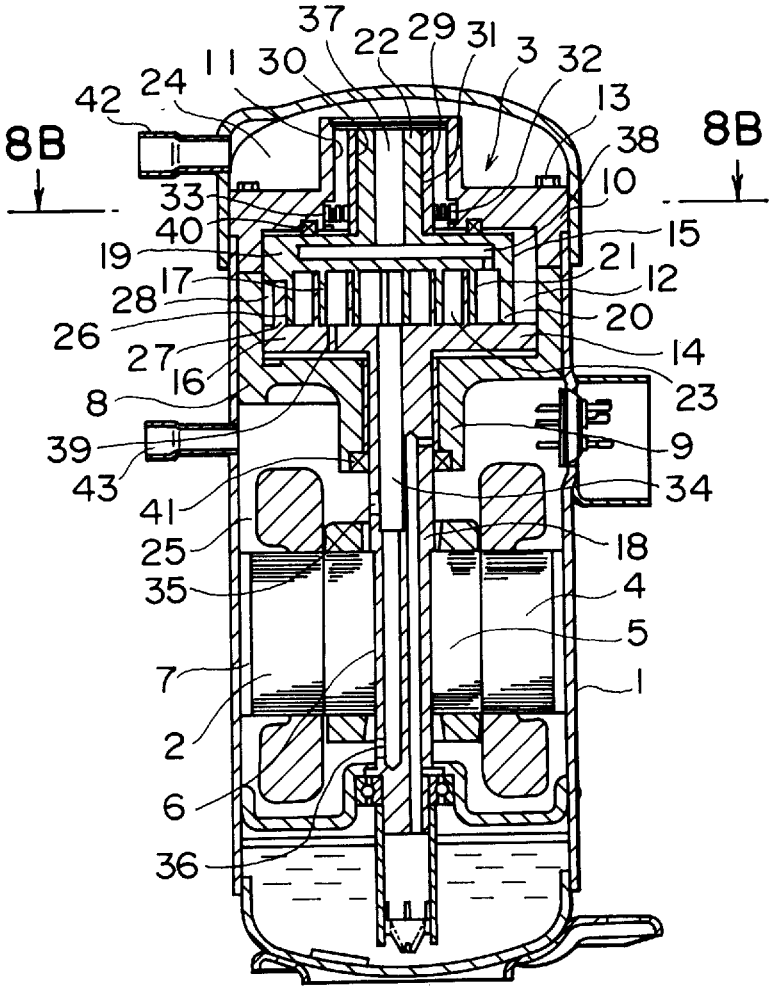
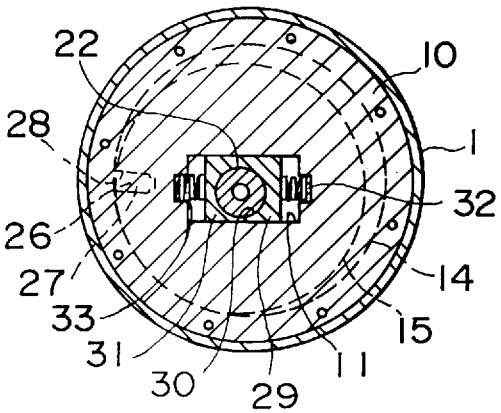
FIG. 8B
(PRIOR ART)

FIG. 9
(PRIOR ART)
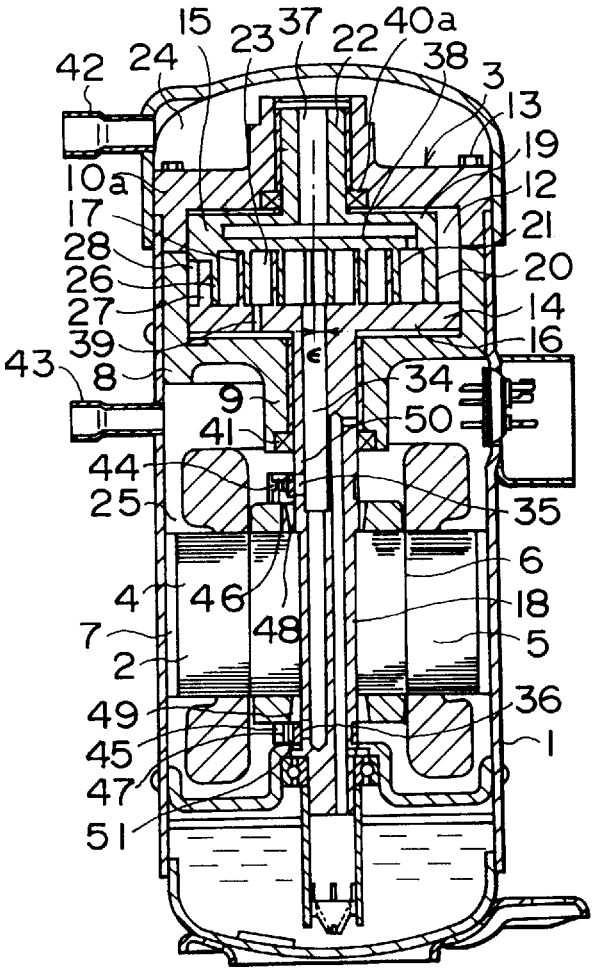
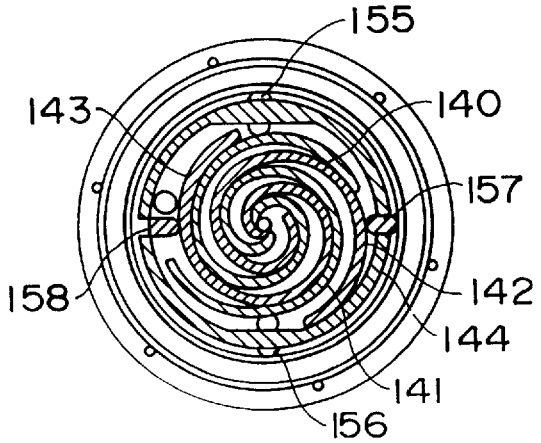
FIG. 10
(PRIOR ART)

ROTATING SCROLL COMPRESSOR HAVING A MOVABLE BEARING MEMBER

RELATED APPLICATION

This application is a continuation of Ser. No. 08/409,710, filed Mar. 24, 1995, abandoned, which is owned by the same assignee.

BACKGROUND OF THE INVENTION

The present invention relates to a rotating type scroll compressor for use with a freezing, air-conditioning, and hot water supplying fluid apparatus, in particular, to improvements of supporting a scroll member of a rotating type scroll compressor and sealing in a radial direction thereof.

As a first related art reference shown in FIG. 8A is a vertical sectional view of an embodiment of a scroll compressor as disclosed in Japanese Patent Laid-Open Publication No. 4-8888. FIG. 8B is a sectional view taken along line 8B—8B of FIG. 8A. Next, the components of the embodiment will be described.

In FIGS. 8A and 8B, reference numeral 1 is a closed shell. An electric drive member 2 is housed at a lower position of the shell. A scroll compressing member 3 is housed at an upper portion of the shell. The electric drive member 2 is composed of a stator 4 and a rotor 5 disposed therein. Between the stator 4 and the rotor 5, an air gap 6 is formed. A passage 7 with a partial cut-out is formed on the outer periphery of the stator 4. Reference numeral 8 is a main frame in contact with the inner wall of the closed shell 1. A main bearing 9 is disposed at the center of the main frame. Reference numeral 10 is an auxiliary frame in contact with the inner wall of the closed shell 1. The auxiliary frame has a sliding groove 11 that has an oval hole. The main frame 8 and the auxiliary frame 10 are secured by bolts 13 so as to form a cavity chamber 12.

The scroll compressing member 3 is composed of a first scroll 14 and a second scroll 15. The first scroll 14 is driven by the electric drive member 2. The second scroll 15 rotates in the same direction as the first scroll 14. The first scroll 14 is composed of a cylindrical end plate 16, a spiral wrap 17, and a main drive shaft 18. The spiral wrap 17 is shaped in an involute curve. The main drive shaft 18 protrudes to the center of the other surface of the end plate 16. The first scroll 14 serves as a drive side scroll. The second scroll 15 is composed of a cylindrical end plate 19, a ring shape wall 20, a spiral shape wrap 21, and a follower shaft 22. The ring shape wall 20 protrudes to one surface periphery of the end plate and slides on the end plate 16 of the first scroll 14. The spiral shape wrap 21 is surrounded by the ring shape wall and formed on the end plate 19. The spiral shape wrap 21 is shaped in a tooth shape with a compensated involute angle. The follower shaft 22 protrudes to the center of the other surface of the end plate 19. The second scroll 15 serves as a follower scroll. The wraps 17 and 21 fit each other in the cavity chamber 12 so that the first and second scrolls 14 and 15 form a plurality of compression spaces 23.

The main frame 8 and the auxiliary frame 10 partition the closed shell 1 as a low pressure chamber 24 and a high pressure chamber 25.

Reference numeral 26 is a drive device. The drive device 26 is composed of a drive pin 27 and a guide groove 28. The drive pin 27 protrudes to the outer periphery of the end plate 16 of the first scroll 14. The guide groove 28 is formed in the radial direction of the ring shaped wall 20 of the second scroll 15. The guide groove is shaped in an U letter shape with an outer cut-out. The circular path of the outer peripheral edge of the guide groove 28 is formed on the outer side of the circular path at the center of the drive pin 27.

Reference numeral 29 is an eccentric bearing member that slidably fits in the sliding groove 11. The eccentric bearing member is composed of an eccentric bush 31 and springs 32 and 33. The eccentric bush 31 has a hole 30 into which the follower shaft 22 of the second scroll 15 is rotatably inserted. The springs 32 and 33 hold the bush from both sides.

The main drive shaft 18 has a discharge hole 34 from which coolant compressed in the compression space 23 is discharged to a high pressure chamber 25. The discharge hole has two discharge openings 35 and 36 that open to the upper portion and the lower portion of the electric drive member 2.

The follower shaft 22 has an intake hole 37 that guides the coolant in the low pressure chamber 24 to the compression space 23. Reference numeral 38 is a connection passage formed on the end plate 19. The passage 38 is connected to the air intake hole 37 so as to deliver the coolant to the compression space 23.

Reference numeral 39 is a small hole formed on the end plate 16 of the first scroll 14. The small hole 39 is connected to the compression space 23 in which the coolant being compressed and the cavity chamber 12. The cavity chamber 12 and the low pressure chamber 24 are sealed by a seal member 40 formed on the sliding surface of the end plate 19 of the auxiliary frame 10 and the second scroll 15. The cavity chamber 12 and the high pressure chamber 25 are sealed by a seal member 41 formed on the sliding surface of the main bearing 9 and the main drive shaft 18.

Reference numeral 42 is an intake pipe. The intake pipe 42 communicates with the low pressure chamber 24. Reference numeral 43 is a discharge pipe that communicates with the high pressure chamber 25.

When the electric drive member 2 of the scroll compressor is rotated, the rotating force is transmitted to the first scroll 14 through the main drive shaft 18. The rotating force of the first scroll 14 is transmitted to the second scroll 15 through the drive device 26 so that the second scroll 15 rotates in the same direction as the first scroll 14. The center position of the eccentric bearing member 29 that fits to the sliding groove 11 deviates from the center of the main drive shaft 18 of the first scroll 14 so that the second scroll 15 rotates about the follower shaft 22.

The first scroll 14 and the second scroll 15 gradually decrease the compression space 23 formed by these scrolls. The coolant that flows from the intake pipe 42 to the low pressure chamber 24 flows from the intake hole 37 of the follower shaft 22 to the compression space 23 through the passage 38 of the end plate 19 so as to compress the coolant. The compressed coolant is discharged from the discharge openings 35 and 36 to the high pressure chamber 25 through the discharge hole 34 formed on the main drive shaft 18 of the first scroll 14. The compressed coolant is discharged to the outside of the closed shell 1 from the discharge pipe 43. The coolant at the intermediate pressure that is being compressed is discharged from the small hole 39 to the cavity chamber 12 so that the resultant compressed coolant works as the back pressure of the first and second scrolls 14 and 15. With a predetermined clearance of the forward edges of the wraps 17 and 21 of the scrolls, the end plates 16 and 19 are slid.

Since the drive device 26 that rotates the second scroll 15 in the same direction as the first scroll 14 forms the circular path at the outer peripheral edge of the guide groove 28 at the outside of the circular path at the center of the drive pin 27, the drive pin 27 can be prevented from dropping from the guide groove 28. The drive pin 27 rotates the second scroll 15 in the same direction as the rotating direction of the first scroll 14 so that the compression space 23 is compressed. Since the center position of the follower shaft 22 is formed in a spiral shape that is an involute shape curve and the wrap 21 of the second scroll 15 is formed in a spiral shape that is a tooth shape curve with a compensated involute angle, when both the first scroll 14 and the second scroll 15 are rotated in the same direction, the compression space 23 is compressed so as to prevent the contact portions of the wraps 7 and 21 from being disengaged and from being abnormally contacted.

Since the seal members 40 and 41 seal the low pressure chamber 24 and the high pressure chamber 25, the low pressure coolant and the high pressure coolant are prevented from entering the cavity chamber 12. The pressure in the cavity chamber 12 is kept at a predetermined intermediate pressure so that the axial sealing force of the first and second scrolls 14 and 15 are maintained in a proper level.

Since the coolant compressed in the compression space 23 is discharged from the upper discharge opening 35 of the electric drive member 2 and the lower discharge opening 36 thereof to the high pressure chamber 25 through the discharge hole 34, the pressure drop of the coolant discharged to the high pressure chamber 25 can be suppressed and the coolant discharged from the discharging opening 36 flows to the discharge pipe 43 through the air gap 6 and the passage 7 of the electric drive member 2, thereby effectively cooling the electric drive member 2 and effectively using the heat given off from the electric drive member 2.

Since the eccentric bearing member 29 is composed of the eccentric bush 31 (which causes the follower shaft 22 of the second scroll 15 to fit to the hole 30 in the sliding groove 11) and the springs 32 and 33 (which hold the eccentric bush 31 from both the sides). Thus, the center of the follower shaft 22 deviates from the center of the main drive shaft 18. In addition, since the springs 32 and 33 hold the eccentric bush 31, when an abnormally high pressure takes place in the compression space 23, the eccentric bush 31 is moved against the elastic force of the springs 32 and 33 in the sliding groove 11 of the oval hole so as to disengage the wrap 21 of the second scroll 15 from the wrap 17 of the first scroll 14. In addition, since the eccentric bearing member 29 does not rotate, the springs 32 and 33, which hold the eccentric bush 31, are not affected by centrifugal force, thereby preventing the spring constants from varying.

By the above-described structure, when an abnormally high pressure takes place, the gap in the radial direction of the wraps of the first scroll and the second scroll can be widened.

As a second related art reference, an embodiment of a scroll compressor as disclosed in Japanese Patent Laid-Open Publication No. 4-12182 will be described. FIG. 9 is a vertical sectional view of this embodiment. For simplicity, the same portions as the first related art reference are denoted by the same reference numerals. Only the different points will be described.

A follower shaft 22 of a second scroll 15 rotates only against an auxiliary frame 10*a*. The follower shaft 22 does not slide in the radial direction. A seal member 40*a* is formed between the follower shaft 22 and an auxiliary frame 10*a*. At discharge openings 35 and 36 formed on a main drive shaft 18, holders 44 and 45, springs 46 and 47, and check valves 50 and 51 are formed. The holders 44 and 45 are mounted on the main drive shaft 18. The check valves 50 and 51 are formed of heavy valves 48 and 49.

In the above-described structure, when the apparatus is operated, centrifugal force is applied to the check valves so as to always open the check valves. With the pressure difference between the discharge hole and the high pressure chamber, the check valves are prevented from being opened and closed. When the apparatus is stopped, it is prevented from being reversely rotated.

As a third related art reference, a scroll type fluid discharging apparatus as disclosed in Japanese Patent Laid-Open Publication No. 50-32512 will be described. FIG. 10 is a horizontal sectional view of a scroll portion of the scroll type fluid discharging apparatus. The outline of the apparatus will be described.

Reference numerals 140 and 141 are two involute spiral wraps of a fixed scroll member. Reference numerals 142 and 143 are two involute spiral wraps of a moving scroll member. As a means for connecting the fixed scroll member and the moving scroll member, a ring 144 is disposed outside both the wraps. Radial protrusions 155 and 156 of the fixed scroll member are slidably formed at a lower groove of the ring 144. Radial protrusions 157 and 158 secured to the wraps 140 and 141 slidably fit to an upper groove of the ring 144. While the apparatus is being driven, the moving wraps 142 and 143 are pressed to the fixing wraps 140 and 141 by centrifugal force so as to hold a radial seal in the compression space.

Each of the rotating type scroll compressors described as the first and second related art references has a shaft portion on the rear surface of the mirror surface on which the scroll wrap is formed. The shaft portion is supported in an overhang structure at a position apart from the lap to which the load of the compressed fluid is applied. Thus, the moment at which the scroll member becomes unstable may take place.

In addition, the radial seal technique in the compression space of the scrolls uses centrifugal force in the case of the sliding type as described in the third related art reference. However, in the rotating type, since both the wraps are rotated, the centrifugal force cannot be used. Thus, to improve the efficiency, the gap in the radial direction should be minimized. In the conventional fixed eccentric system, the assembling accuracy was very important.

SUMMARY OF THE INVENTION

According to the rotating scroll compressor of the present invention, rotating shaft portions that are affected by radial force of a rotating drive scroll portion and a follower scroll portion are disposed at upper and lower wraps and support bearings are disposed at upper and lower portions of scroll wraps. Thus, the unstable moment can be completely removed and thereby the scroll members can operate in a stable manner.

In addition, since the shaft that supports one scroll is radially moved against the bearing that supports the other scroll, the shaft that supports the first scroll is radially moved corresponding to the load of the compressed fluid against the bearing that supports the second scroll. Thus, since the radial gap can be easily removed, the apparatus can be effectively operated without high assembling accuracy.

These and other objects, features and advantages of the present invention will become more apparent in light of the following detailed description of a best mode embodiment thereof, as illustrated in the accompanying drawings.

BRIEF DESCRIPTION OF DRAWINGS

FIG. 2A is an enlarged vertical sectional view of a scroll portion, FIG. 2B is a sectional view taken along line 2B—2B of FIG. 2A;

FIG. 3A is an enlarged vertical sectional view of a scroll portion, FIG. 3B is a sectional view taken along line 3B—3B of FIG. 3A;

FIG. 4A is a vertical sectional view, FIG. 4B is a sectional view taken along line 4B—4B of FIG. 4A.

FIG. 5A is a vertical sectional view, FIG. 5B is a sectional view taken along line 5B—5B of FIG. 5A;

FIG. 6A is a vertical sectional view, FIG. 6B is a sectional view taken along line 6B—6B of FIG. 6A;

FIG. 7A is a vertical sectional view, FIG. 7B is a sectional view taken along line 7B—7B of FIG. 7A;

FIGS. 8A & 8B show a conventional scroll compressor, FIG. 8A is a vertical sectional view, FIG. 8B is a sectional view taken along line 8B—8B of FIG. 8A;

FIG. 9 is a vertical sectional view showing another conventional scroll compressor; and FIG. 10 is a horizontal sectional view showing a scroll portion of a conventional scroll type fluid discharging apparatus.

DETAILED DESCRIPTION OF THE PREFERRED EMBODIMENTS

Next, with reference to FIGS. 1 to 7, embodiments of rotating type scroll compressors according to the present invention will be described.

Figure 1:
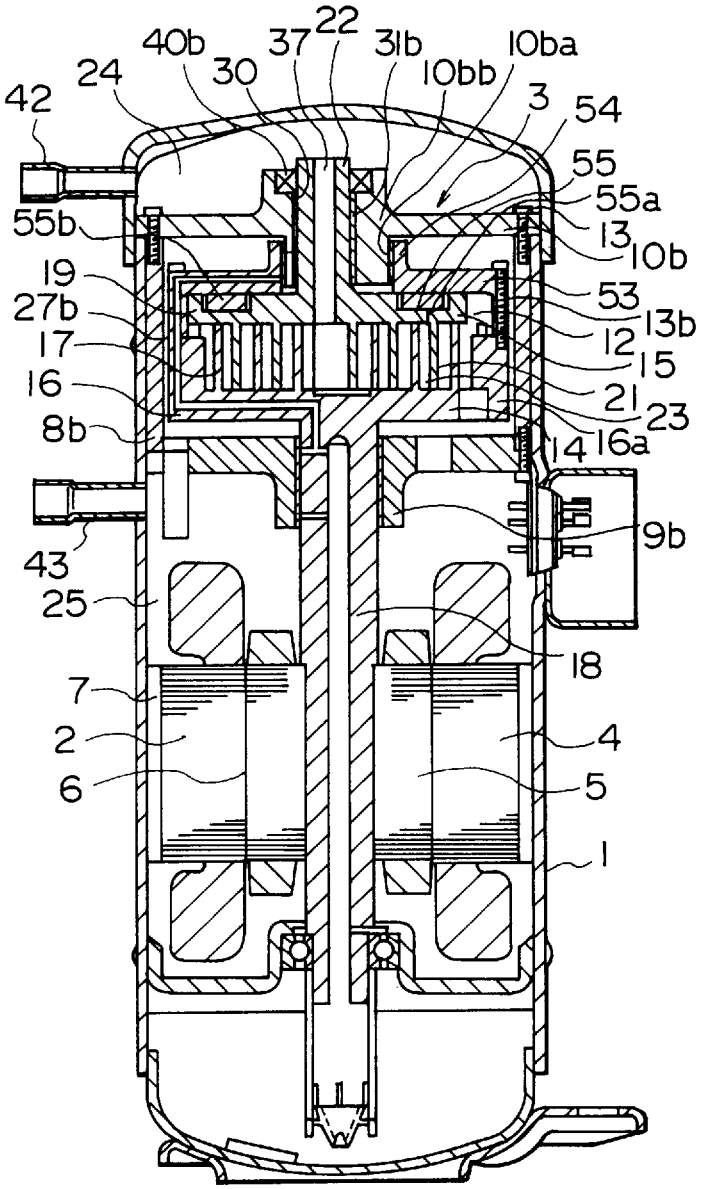
FIG. 1 is a vertical sectional view of a rotating type scroll compressor according to a first embodiment of the present invention.

FIG. 1 is a vertical sectional view showing a rotating type scroll compressor according to a first embodiment of the present invention. For simplicity, in FIG. 1, the same portions as the structure shown in FIG. 8 are denoted by the same reference numerals. Only the different points will be described.

A drive scroll member (first scroll) 14 has a scroll wrap 17 and a rotating shaft portion (rotating shaft) 18. The scroll wrap 17 is disposed on an end plate 16. The rotating shaft 18 is disposed on the opposite side of the scroll wrap 17. A vertical member 16*a* extends on the scroll wrap side of the outer peripheral portion of the end plate 16. A rotating shaft portion (auxiliary bearing member) 53 is secured to the vertical member 16*a* by a bolt 13*b*. The rotating center axial line of the bearing portion 54 of the auxiliary bearing member 53 accords with the rotating center axial line of the rotating shaft 18. The drive scroll member 14 is supported by a lower main bearing 9*b* and an upper bearing member 10*b* and rotated by the rotating shaft 18 and the bearing portion 54. The upper bearing member 10*b* supports the upper bearing portion 54 of the drive scroll member 14 at an outer peripheral portion 10*ba*. In addition, the upper bearing member 10*b* and an inner diameter portion 10*bb* support the rotating shaft portion 22 of the follower scroll member (second scroll) 15. Reference numeral 31*b* is a bush. The center axial line of the outer peripheral portion 10*ba* of the upper bearing member 10*b* and the center axial line of the inner peripheral portion 10*bb* are eccentrically formed corresponding to the eccentric amount of the scroll members 14 and 15, respectively. The auxiliary bearing member 53 is an auxiliary bearing of the drive scroll member 14. The auxiliary bearing member 53 axially nips the scroll member 15 and functions as a restricting member against the axial motion. In addition, the auxiliary bearing member 53 prevents the freezing performance from lowering at the initial operation of the apparatus. A ring shape intermediate pressure chamber 55 is formed between the auxiliary bearing member 53 and the end plate 19. The intermediate chamber 55 has a sealing member 55*b* with an O ring. The intermediate chamber 55 is connected to the compression space 23 through a small hole 55*a*. Thus, a back-pressure is applied to the follower scroll member so as to reduce the load in the thrust direction.

Since the radial load works for the wraps, the structure with the bearings disposed at the upper and lower portions of the wraps, the rotating operation can be much stably performed than the conventional over-hang structure.

Figure 2A:
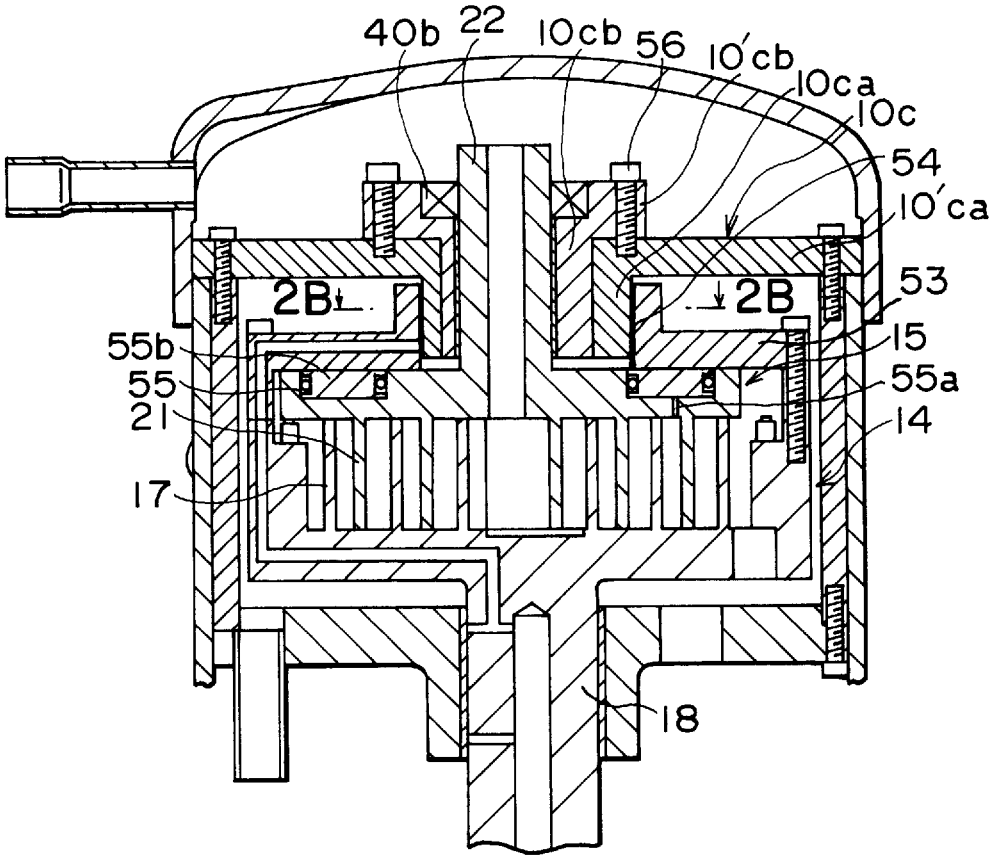
FIGS. 2A & 2B show a rotating type scroll compressor according to a second embodiment of the present invention.
Figure 2B:
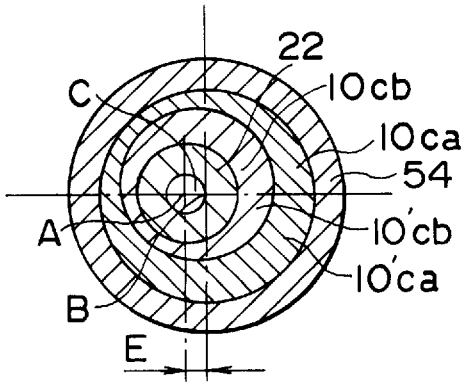

FIG. 2 shows a rotating scroll compressor according to a second embodiment of the present invention. FIG. 2A is an enlarged vertical sectional view showing a scroll portion. FIG. 2B is a sectional view taken along line 2B—2B of FIG. 2A. The structure of the second embodiment is nearly the same as that shown in FIG. 1. For simplicity, the same portions as the structure of the first embodiment are denoted by the same reference numerals. Only the different points will be described.

An upper bearing 10*c* is divided into a portion 10'*ca* that contains an outer peripheral portion 10*ca* and a portion 10'*cb* that contains an inner peripheral portion 10*cb*. Both the portions are secured by bolts 56. As shown in FIG. 2B, since a center axial line B of the portion 10'*ca*, which contains the outer peripheral portion 10*ca*, deviates from a center axial line C of the portion 10'*ca*, which contains the inner peripheral portion 10*cb*. Thus, by rotating the portion 10'*cb* containing the inner peripheral portion 10*cb* and adjusting an eccentric amount E of a main drive shaft 18 against a center axial line A of a follower shaft 22, the bolts 56 (see FIG. 2A) are tightened so as to assemble them.

Figure 3A:
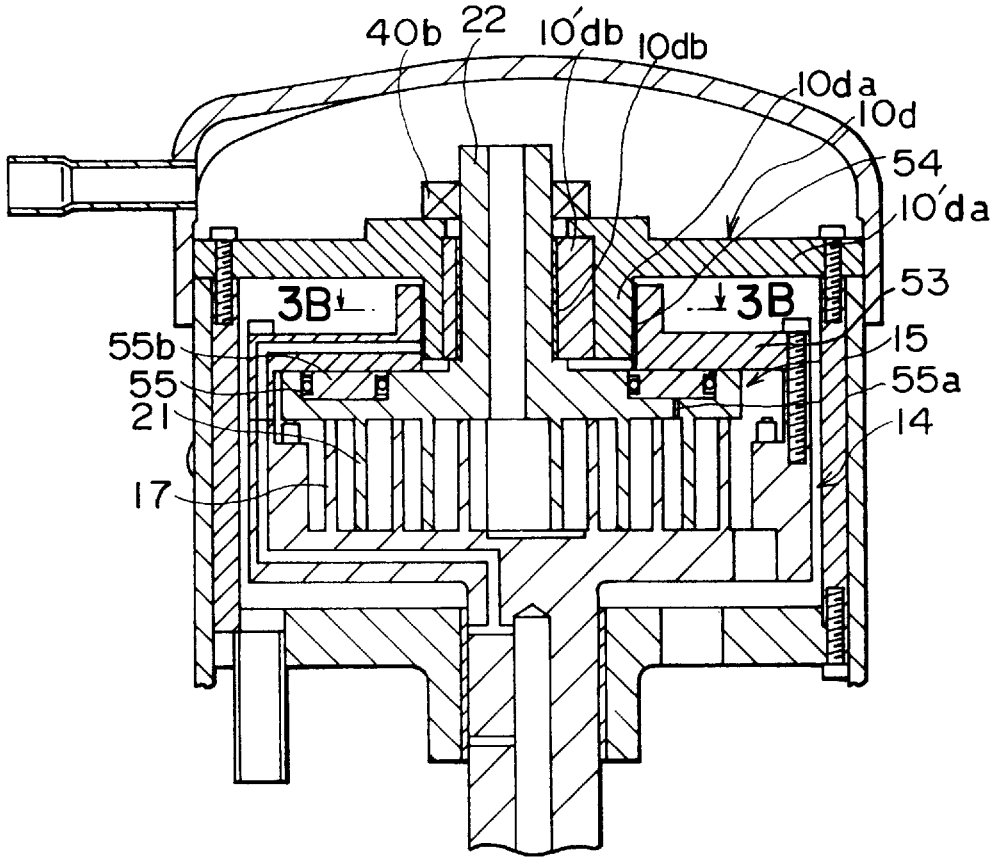
FIGS. 3A & 3B show is a rotating type scroll compressor according to a third embodiment of the present invention.
Figure 3B:
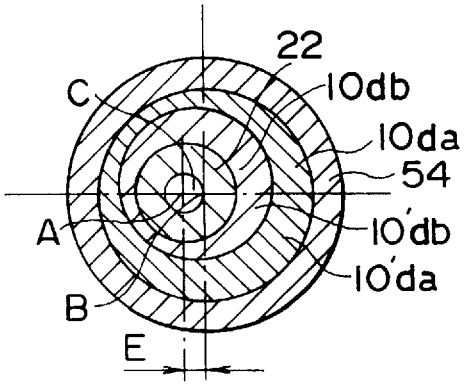

FIG. 3 shows a rotating type scroll compressor according to a third embodiment of the present invention. FIG. 3A is an enlarged vertical sectional view of a scroll portion. FIG. 3B is a sectional view taken along line 3B—3B of FIG. 3A. The structure of the third embodiment is nearly the same as that shown in FIG. 1. For simplicity, the same portions as the structure shown in FIG. 1 are denoted by the same reference numerals. Only the different points will be described.

As with the second embodiment, an upper bearing portion 10*d* is divided into a portion 10'*da* that contains an outer peripheral portion 10*da* and a portion 10'*db* that contains an inner peripheral portion 10*db*. The portion 10'*db*, which contains the inner peripheral portion 10*db*, deviates from the portion 10'*da*, which contains the outer peripheral portion 10*da*. The portion 10'*db* is relatively moved against the portion 10'*da* for a predetermined length. While the apparatus is being operated, with the load of the radial fluid that works for the scroll member 15, a center axial line C of the inner peripheral portion 10*db* is set so that an eccentric amount E (see FIG. 3B) of the portion 10'*da* containing the outer peripheral portion 10*da* increases against the inner peripheral portion 10*db* due to the load of the radial fluid that works for the scroll member 15. Thus, while the apparatus is being operated, the fluid pressure causes the portion 10'*da*, which contains the outer peripheral portion 10*da*, and the portion 10'*db*, which contains the inner peripheral portion 10*db* to rotate in the direction of which the distance between A and B increases. Thus, the wraps 17 and 21 in the radial direction can be completely sealed.

Figure 4A:
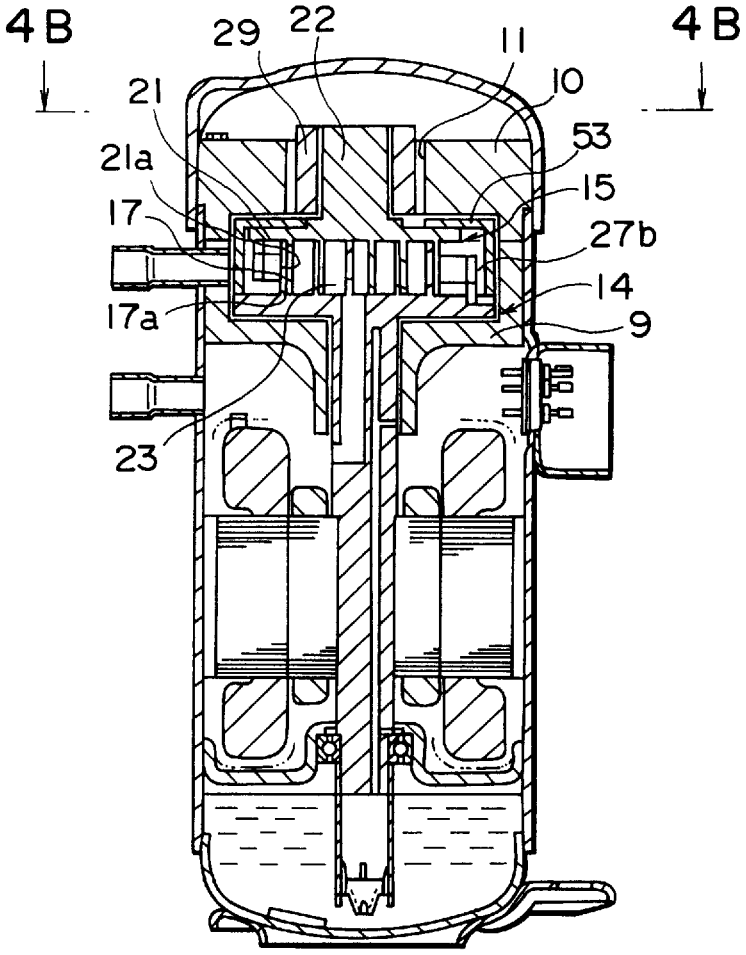
FIGS. 4A & 4B show is a rotating type scroll compressor according to a fourth embodiment of the present invention.
Figure 4B:
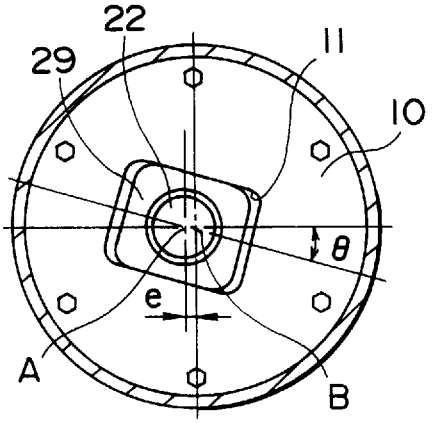
Figure 4C:
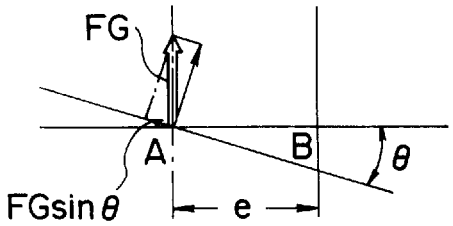
FIG. 4C is a schematic diagram for explaining the load applied to a scroll member.

FIG. 4 shows a rotating type scroll compressor according to a fourth embodiment of the present invention. FIG. 4A is a vertical sectional view. FIG. 4B is a sectional view taken along line 4B—4B of FIG. 4A. FIG. 4C is a schematic diagram for explaining the load applied to a scroll member. The structure of the fourth embodiment is nearly the same as that shown in FIGS. 8A and 8B. For simplicity, the same portions as the structure shown in FIGS. 8A and 8B are denoted by the same reference numerals. Only the different points will be described.

A bearing member 29 is straightly moved in a direction with an angle θ (see FIG. 4B) to an eccentric direction B→A connected between center axial lines B and A of both scroll members 14 and 15 through a sliding groove 11 of an auxiliary housing 10. As shown in FIG. 4C, a component of a slide direction load FG sin θ of a load FG in a radial direction that works nearly perpendicular to B→A. The follower scroll member 15 is pressed until a side wall 21*a* of the wrap 21 comes in contact with a side wall 17*a* of the wrap 17, thereby sealing the lap 17 in the radial direction.

Figure 5A:
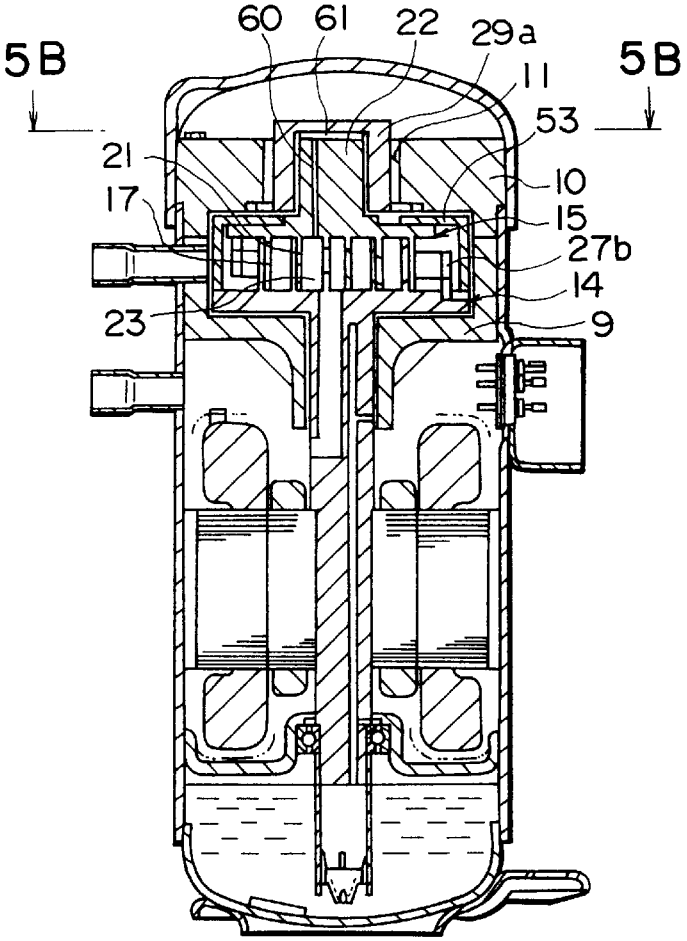
FIGS. 5A & 5B show a rotating type scroll compressor according to a fifth embodiment of the present invention.
Figure 5B:
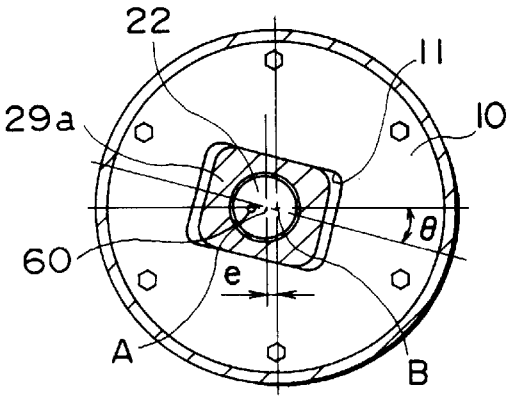

FIG. 5 shows a rotating type scroll compressor according to a fifth embodiment of the present invention. FIG. 5A is a vertical sectional view. FIG. 5B is a sectional view taken along line 5B—5B of FIG. 5A.

The structure of the fifth embodiment is nearly the same as that shown in FIG. 4. Only the different points will be described. A bearing member 29*a* has a top-closed chamber 61. High pressure that is being compressed or that has been compressed is delivered from a compression space 23 through a small hole 60 formed in a follower shaft 22. By applying back pressure to the follower scroll 15, the load in the thrust direction of the follower scroll 15 is reduced.

Figure 6A:
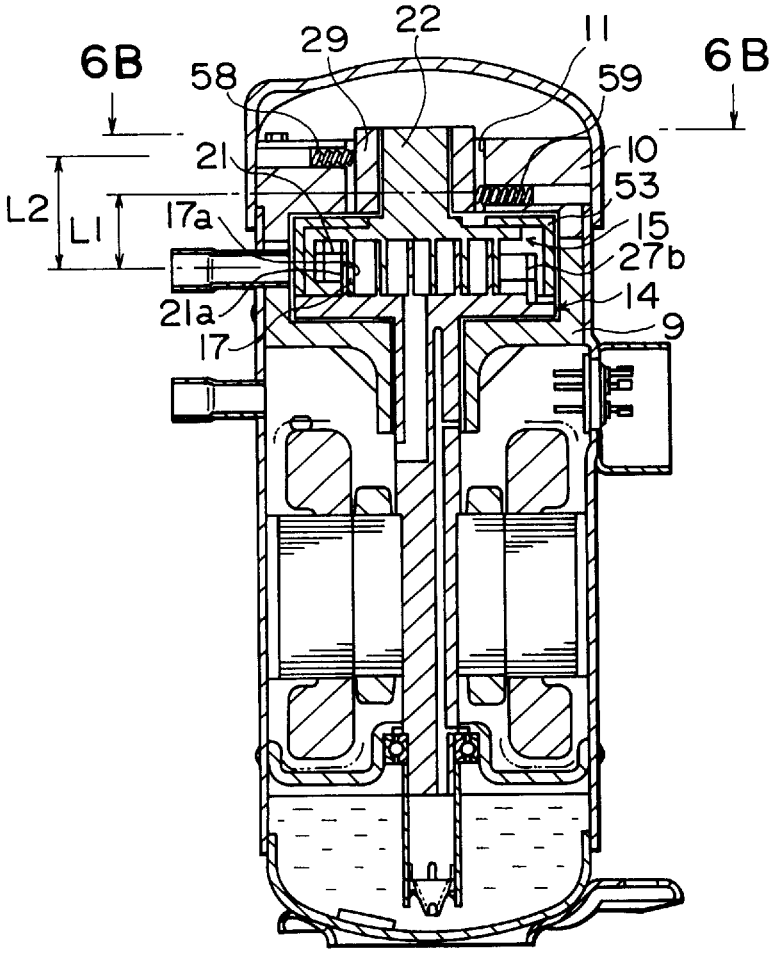
FIGS. 6A & 6B show a rotating type scroll compressor according to a sixth embodiment of the present invention.
Figure 6B:
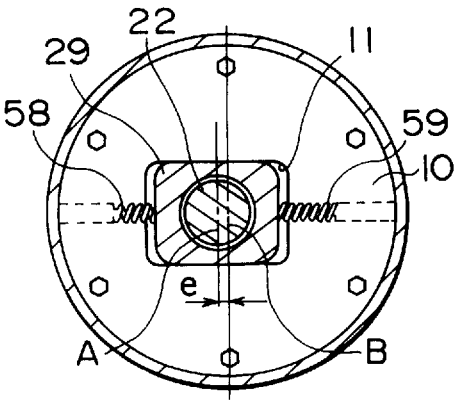

FIG. 6 shows a rotating type scroll compressor according to a sixth embodiment of the present invention. FIG. 6A is a vertical sectional view. FIG. 6B is a sectional view taken along 6B—6B of FIG. 6A.

The structure of the sixth embodiment is nearly the same as that shown in FIGS. 4A and 4B. Only the different points will be described. A bearing member 29 is movable to a main bearing 9 through a sliding groove 11 of an auxiliary housing 10. A spring 59 applies tension against one face 292 of the bearing member 29 and a follower scroll member 15 in the direction so that an eccentric amount e (see FIG. 6B) increases. The follower scroll member 15 is pressed until a wrap 21 comes in contact with a wrap 17 of a drive scroll member 14. Thus, the side walls 21*a* and 17*a* of the wraps are sealed. When the spring 59 tensions the follower scroll member 15, the spring 58 acting on an opposing face 291 of bearing member 29 and tensions the bearing member 29 in the opposite direction of the tension of the spring 59 so as to prevent the follower scroll member 15 from being inclined due to the moment of the distance L1 from the wrap contact point to the spring 59. A force F58 of the spring 58 and a force F59 of the spring 59 are given by the following equations.

$$F59 \times L1 = F58 \times L2 \ldots \quad (1)$$

$$F = F59 - F58 \ldots \quad (2)$$

Thus, the following equations are obtained.

$$F59 = F/(1 - L1/L2)$$

$$F58 = F59 - F$$

Figure 7A:
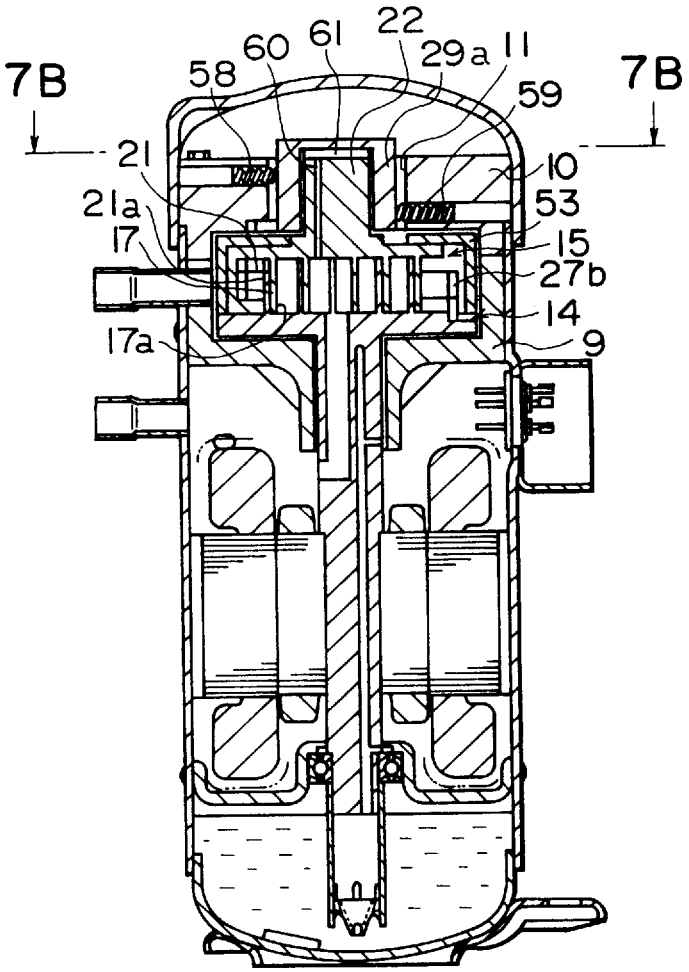
FIGS. 7A & 7B show a rotating type scroll compressor according to a seventh embodiment of the present invention.
Figure 7B:
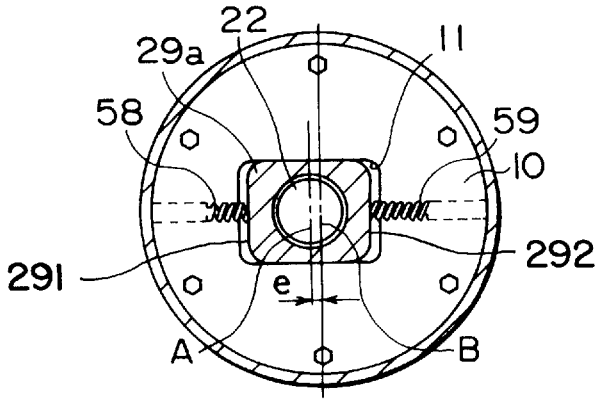

FIG. 7 shows a rotating type scroll compressor according to a seventh embodiment of the present invention. FIG. 7A is a vertical sectional view. FIG. 7B is a sectional view taken along 7B—7B of FIG. 7A.

The structure of the seventh embodiment is formed by applying the structure shown in FIG. 5 to the structure shown in FIG. 6. For simplicity, the detail description of the seventh embodiment is omitted.

According to the rotating type scroll compressors of the present invention, as described in the above-mentioned various embodiments, with a relatively simple changeof a structure, the operation of the scroll member becomes stable, thereby preventing the noise and reducing wear-out of the apparatus. In addition, the gap between the wraps can be easily adjusted without high assembling accuracy. Thus, the machining steps and assembling steps can be reduced so as to reduce the cost of the apparatus. Moreover, the coefficient of compresibility (C.O.P) can be improved.

Although the present invention has been shown and described with respect to a best mode embodiment thereof, it should be understood by those skilled in the art that the foregoing and various other changes, omissions, and additions in the form and detail thereof may be made therein without departing from the spirit and scope of the present invention.

What is claimed is:

1. A rotating scroll compressor comprising:

a scroll compressing unit including a drive scroll member having a spiral-shaped wrap extending in a first direction from an end plate, a follower scroll member having a center axial line that deviates from a center axial line of said drive scroll member by an eccentric amount and having a spiral-shaped wrap extending in a direction opposite to said first direction and interfitting with said spiral-shaped wrap of said drive scroll member, compression spaces being formed between said drive scroll member and said follower scroll member, the side walls of said wraps of said drive scroll member and said follower scroll member being in contact with each other so as to seal the compression spaces in the radial direction;

an electric drive unit having a first shaft portion coupled to said drive scroll member to rotate said drive scroll member;

a main bearing within which said first shaft portion rotates;

means for coupling said drive scroll member to said follower scroll member to rotate said follower scroll member;

an upper shaft portion connected to said follower scroll member and an auxiliary bearing member within which said upper shaft portion rotates;

an auxiliary frame secured to said main bearing within which said auxiliary bearing is moveable;

said rotating upper shaft portion being subject to the applied radial force of the fluid compressed by said rotating drive scroll member and said follower scroll member, and said auxiliary bearing member being moveable in a direction toward said auxiliary frame; and an elastic member on each of two spaced planes perpendicular to and opposite the axial line of the axis of rotation of said rotating upper shaft portion for tensioning said auxiliary bearing member to increase the eccentric amount of said upper shaft portion relative to the center axial line of said drive scroll member.

2. The rotating type scroll compressor as set forth in claim 1, wherein the moving direction of said auxiliary bearing member has a predetermined angle in an eccentric direction that connects the rotating center axial line of said drive scroll member and the rotating center axial line of said follower scroll member, said auxiliary bearing member being moved so that a component of the load of the fluid in the radial direction that works for said follower scroll member causes the eccentric amount to increase.

3. The rotating scroll compressor as set forth in claim 1, wherein the part of the elastic member closest to the wraps of the scroll members tensions said auxiliary bearing member in the eccentric direction, and the part of the elastic member more remote from the wraps of the scroll members tensions said auxiliary bearing member in the opposite direction to that of the eccentric direction.

* * * * *